US009333470B1

(12) United States Patent
Fore

(10) Patent No.: US 9,333,470 B1
(45) Date of Patent: May 10, 2016

(54) BOTTLE AGITATION DEVICE

(71) Applicant: Steve Fore, Carlisle, PA (US)

(72) Inventor: Steve Fore, Carlisle, PA (US)

( * ) Notice: Subject to any disclaimer, the term of this patent is extended or adjusted under 35 U.S.C. 154(b) by 95 days.

(21) Appl. No.: 14/105,296

(22) Filed: Dec. 13, 2013

(51) Int. Cl.
*B01F 11/00* (2006.01)

(52) U.S. Cl.
CPC ..... *B01F 11/0005* (2013.01)

(58) Field of Classification Search
CPC ..... B01F 11/006; B01F 11/0008; B01F 11/0071; B01F 11/0082–11/0091; B01F 11/0005
USPC ..... 366/110–114
See application file for complete search history.

(56) References Cited

U.S. PATENT DOCUMENTS

| | | | | | |
|---|---|---|---|---|---|
| 2,034,902 | A | * | 3/1936 | Heinze | 366/209 |
| 2,610,041 | A | * | 9/1952 | Stahl | 366/215 |
| 2,846,201 | A | * | 8/1958 | Mermelstein | 366/110 |
| 3,120,368 | A | * | 2/1964 | Crisp | 248/103 |
| 3,173,664 | A | * | 3/1965 | Isaacson et al. | 366/111 |
| 4,316,672 | A | | 2/1982 | Kerscher | |
| 4,318,622 | A | * | 3/1982 | Sterrenberg | 366/110 |
| 4,420,262 | A | * | 12/1983 | Sterrenberg | 366/110 |
| 4,893,938 | A | | 1/1990 | Anderson | |
| 5,050,996 | A | * | 9/1991 | Allen | 366/211 |
| 5,054,339 | A | | 10/1991 | Yacowitz | |
| 5,273,357 | A | | 12/1993 | Currie | |
| 5,399,013 | A | | 3/1995 | Sawyer | |
| 5,401,242 | A | | 3/1995 | Yacowitz | |
| 5,439,287 | A | * | 8/1995 | Roepke, Sr. | 366/130 |
| 5,971,599 | A | | 10/1999 | Bothers | |
| 6,709,148 | B2 | * | 3/2004 | Glass | 366/110 |
| D609,990 | S | * | 2/2010 | Blair | D8/71 |
| 7,997,787 | B2 | * | 8/2011 | Blair | 366/110 |
| D665,643 | S | * | 8/2012 | Brinton | D8/70 |
| 8,465,195 | B1 | * | 6/2013 | Boldt | 366/110 |
| 2003/0214876 | A1 | * | 11/2003 | Glass | 366/209 |
| 2007/0201301 | A1 | * | 8/2007 | Klepinger | 366/110 |
| 2009/0161479 | A1 | * | 6/2009 | Blair | 366/130 |
| 2012/0163117 | A1 | | 6/2012 | Guidry, Jr. et al. | |

* cited by examiner

*Primary Examiner* — David Sorkin
*Assistant Examiner* — Abbas Rashid

(57) ABSTRACT

A bottle agitation device agitates the contents of bottles such as tattooing ink or the like. The device includes a housing and a post coupled to and extending upwardly from a top wall of the housing. A support wall is coupled to an upper end of the post. The support wall is concavely arcuate wherein the support wall is configured for receiving and supporting a bottle thereon. A base wall is coupled to an end of the support wall. A vibrational unit is positioned in the housing. The vibrational unit agitates the support wall for agitating the bottle when the bottle is supported on the support wall.

7 Claims, 3 Drawing Sheets

BOTTLE AGITATION DEVICE

BACKGROUND OF THE DISCLOSURE

Field of the Disclosure

The disclosure relates to agitation devices and more particularly pertains to a new agitation device for agitating the contents of bottles such as tattooing ink or the like.

SUMMARY OF THE DISCLOSURE

An embodiment of the disclosure meets the needs presented above by generally comprising a housing and a post coupled to and extending upwardly from a top wall of the housing. A support wall is coupled to an upper end of the post. The support wall is concavely arcuate wherein the support wall is configured for receiving and supporting a bottle thereon. A base wall is coupled to an end of the support wall. A vibrational unit is positioned in the housing. The vibrational unit agitates the support wall for agitating the bottle when the bottle is supported on the support wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
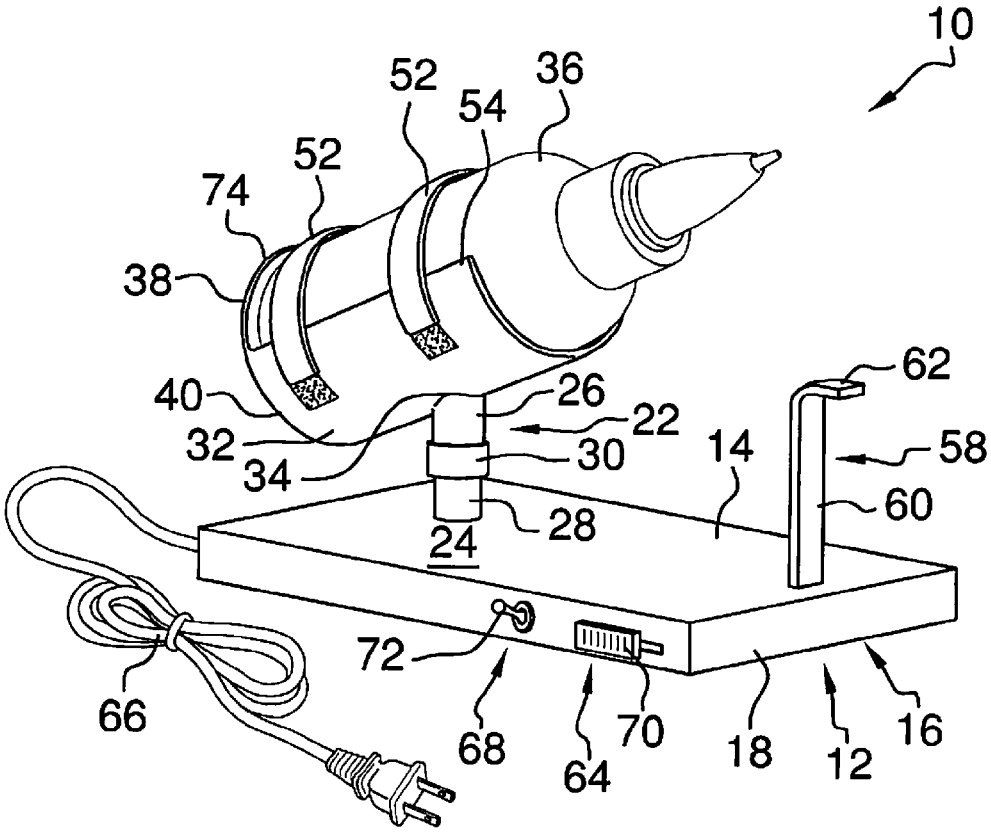
FIG. 1 is a top front side perspective view of a bottle agitation device according to an embodiment of the disclosure.
Figure 2:
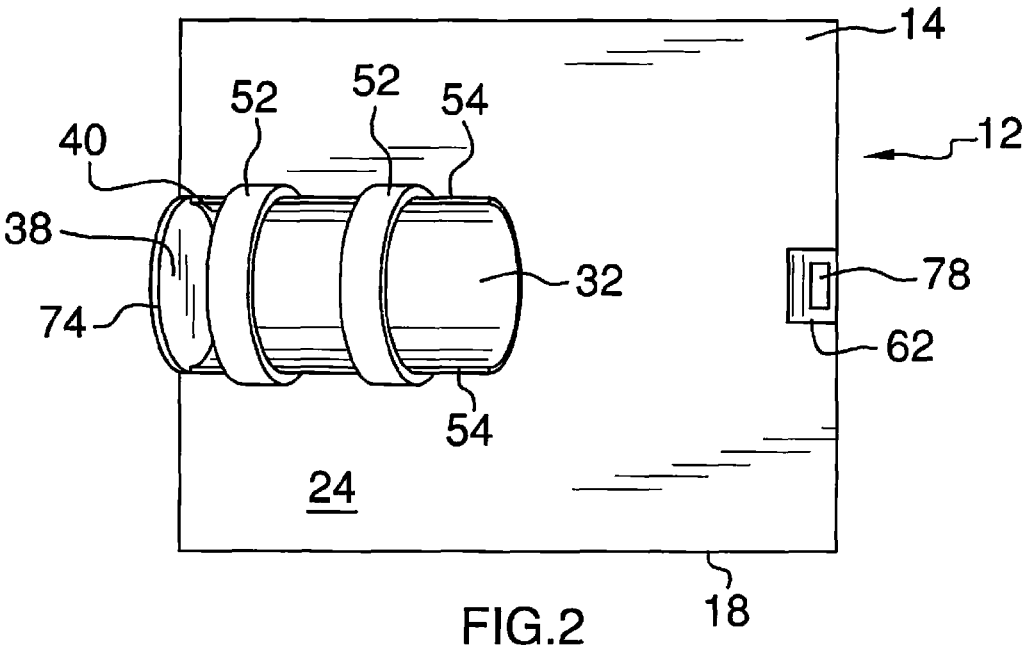
FIG. 2 is a top view of an embodiment of the disclosure.
Figure 3:
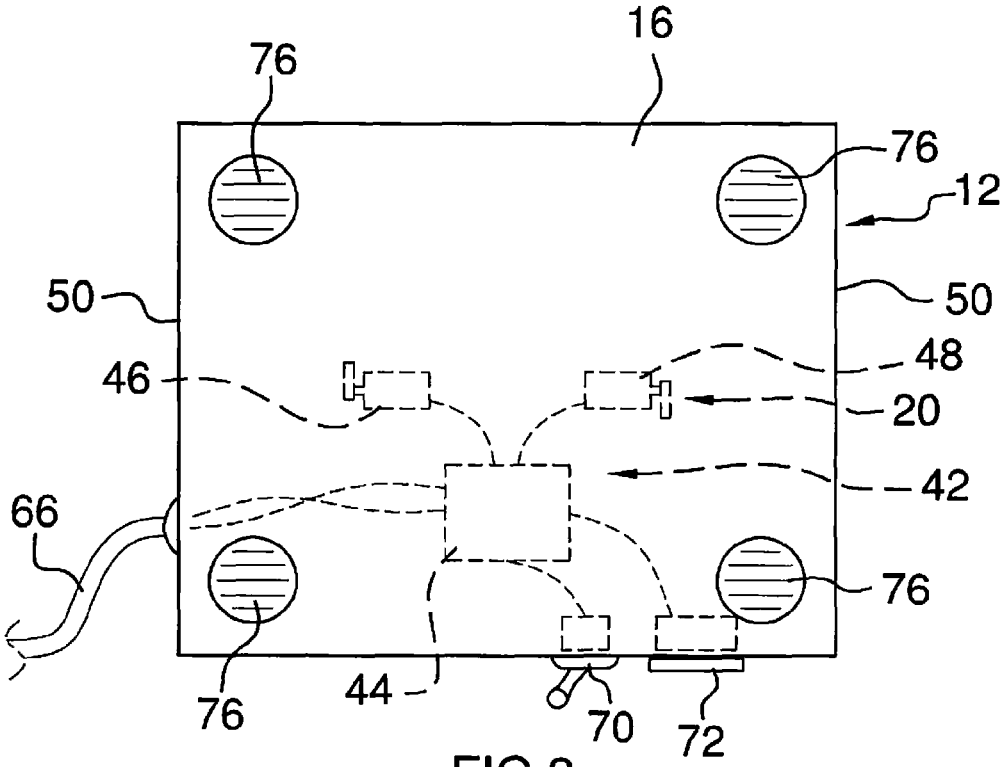
FIG. 3 is a bottom view of an embodiment of the disclosure.
Figure 4:
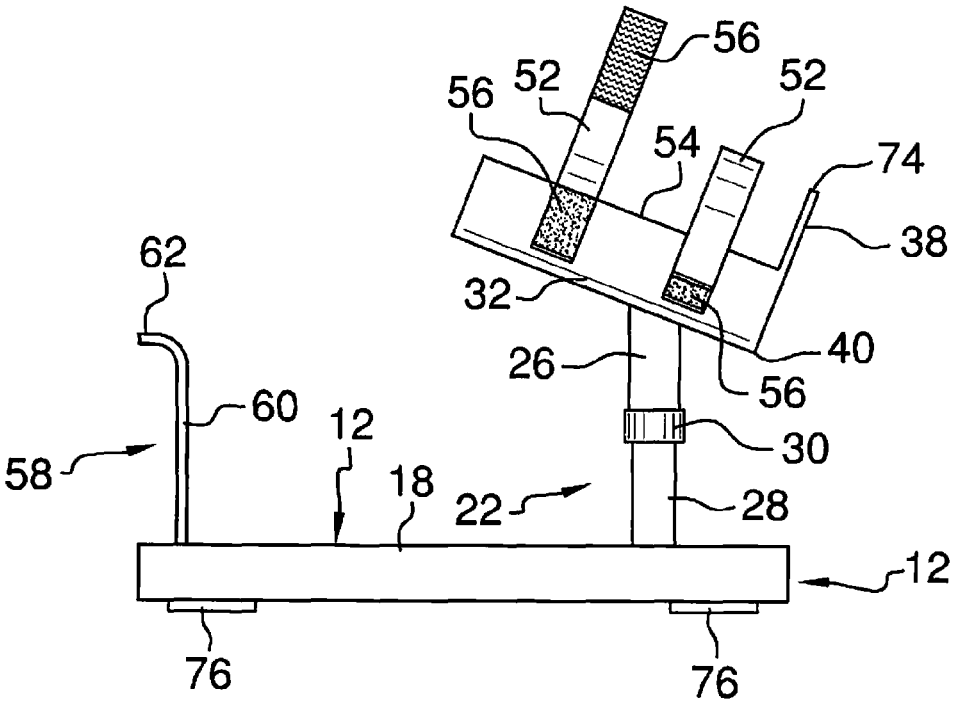
FIG. 4 is a side view of an embodiment of the disclosure.
Figure 5:
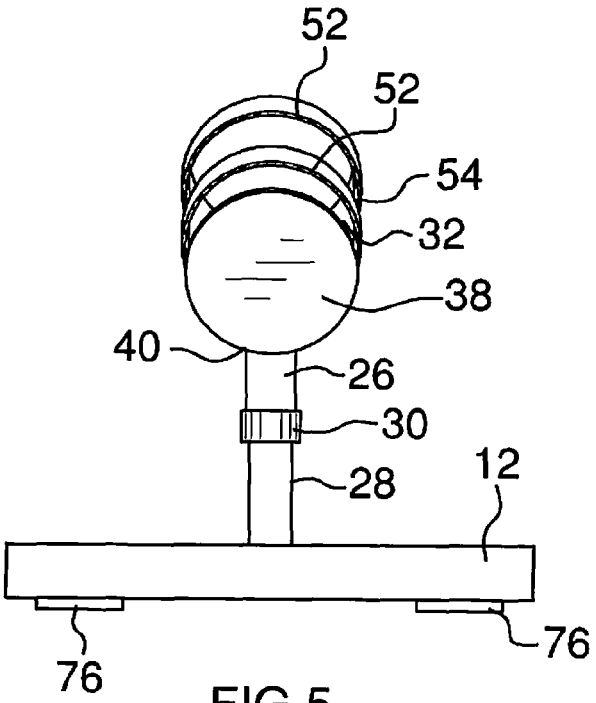
FIG. 5 is a back view of an embodiment of the disclosure.

With reference now to the drawings, and in particular to FIGS. 1 through 5 thereof, a new agitation device embodying the principles and concepts of an embodiment of the disclosure and generally designated by the reference numeral 10 will be described.

As best illustrated in FIGS. 1 through 5, the bottle agitation device 10 generally comprises a substantially planar low profile housing 12 having a top wall 14, a bottom wall 16, and a perimeter wall 18 coupled to and extending between the top wall 14 and the bottom wall 16 defining an interior space 20 of the housing 12. The top wall 14 and the bottom wall 16 of the housing 12 are each planar.

A post 22 is coupled to and extends upwardly from an upper surface 24 of the top wall 14 of the housing 12. The post

22 may comprise a top section 26 and a bottom section 28. The top 26 section may be selectively removable from the bottom section 28 and secured by a compression ring 30 or the like in conventional fashion. A support wall 32 is coupled to an upper end 34 of the post 22. The support wall 32 is concavely arcuate such that the support wall 32 is configured for receiving and supporting a bottle 36 thereon. A base wall 38 is coupled to an end 40 of the support wall 32. The support wall 32 is angled relative to the top wall 14 wherein the support wall 32 extends upwardly and away from the base wall 38 such that the bottle 36 is prevented from sliding off of the support wall 32. The base wall 34 may be disc-shaped and have an upper edge 74 extending from the support wall 32.

A vibrational unit 42 is positioned in the housing 12. The vibrational unit 42 agitates the support wall 32 through agitation of the housing 12 transferred to the support wall 32 through the post 22. Thus, the vibrational unit 42 is configured for agitating the bottle 36 when the bottle 36 is supported on the support wall 32. The vibrational unit 42 comprises a processor 44 positioned in the housing 12 and a first motor 46 also positioned in the housing 12. The first motor 46 is operationally coupled to the processor 44 wherein the processor 44 controls operation of the first motor 46 to vibrate the housing 12. The vibrational unit 42 may comprise a second motor 48 positioned in the housing 12. The second motor 48 is operationally coupled to the processor 44 wherein the processor 44 controls operation of the second motor 48 to vibrate the housing 12. Operation of the first motor 46 and the second motor 48 may be coordinated through the processor 44 to enhance or selectively provide variation in the vibrations provided to the support wall 32 through the post 22. The first motor 46 and the second motor 46 may each be positioned proximate a respective end 50 of the housing 12.

A plurality of straps 52 may be coupled to the support wall 32. Each strap 52 is extendable between opposite side edges 54 of the support wall 32 and couplable to the support wall 32 using a fastener 56 such as hook and loop fastener or the like. Thus, each strap 52 is configured for securing the bottle 36 on the support wall 32 to enhance transference of vibration to the bottle 36 and prevent the bottle 36 from inadvertently falling off of the support wall 32. The device 10 may be sized to accommodate variously sized bottles and top section 26 may be interchangeable and attached to variously sized support walls 32 to accommodate the variously sized bottles. The device 10 may be used particularly for agitating bottles of ink used in tattooing as the mechanical agitation prevents the tattoo artist from having to manually agitate the bottles in a manner that could tire the artist's arm while working.

A stand 58 is coupled to and extends upwardly from the housing 12. The stand 58 has a first straight section 60 extending transversely from the top wall 14. The stand 58 has a second section 62 extending transversely from the first section 60. The second section 62 extends laterally outward vertically aligned with the perimeter wall 18 wherein the stand 58 is configured for supporting a tattoo gun or the like positioned adjacent to the housing 12. An aperture 78 may extend through the second section 62 to facilitate securing the tattoo gun or the like to the stand 58.

A vibration control 64 is operationally coupled to the vibrational unit 42 wherein manipulation of the vibration control 64 selectively varies a frequency or speed of vibration produced by the vibrational unit 42. A power source 66 such as a battery or electrical cord configured for being electrically coupled to a power outlet is electrically coupled to the vibrational unit 42. A switch 68 is electrically coupled between the power source 66 and the vibrational unit 42 wherein manipulation of the switch 68 selectively provides electric power to the vibrational unit 42 from the power source 66. The vibration control 64 may be a slider 72 positioned on the perimeter wall 18. The switch 68 may be a toggle switch 70 positioned on the perimeter wall adjacent to the vibration control 64. A plurality of feet 76 may be positioned on the bottom wall 16. The feet 76 may be constructed of rubber or the like to inhibit movement of the housing 12 on a surface while the vibrational unit 42 is activated.

In use, the bottle 36 is positioned on the support wall 32 and secured using straps 52. The switch 68 is manipulated to actuate the vibrational unit 42 to agitate the bottle 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A bottle agitation device comprising:

a housing having a top wall, a bottom wall, and a perimeter wall coupled to and extending between said top wall and said bottom wall defining an interior space of said housing;

a post coupled to and extending upwardly from said top wall of said housing;

a support wall coupled to an upper end of said post, said support wall being concavely arcuate wherein said support wall is configured for receiving and supporting a bottle thereon;

a base wall coupled to an end of said support wall;

a vibrational unit positioned in said housing, said vibrational unit agitating said support wall wherein said vibrational unit is configured for agitating the bottle when the bottle is supported on the support wall, said vibrational unit comprising a processor positioned in said housing and a first motor positioned in said housing, said first motor being operationally coupled to said processor wherein said processor controls operation of said first motor to vibrate said housing, said vibrational unit comprising a second motor positioned in said housing, said second motor being operationally coupled to said processor wherein said processor controls operation of said second motor to vibrate said housing;

a stand coupled to and extending upwardly from said housing, said stand extending from said top wall, said stand having a first straight section extending transversely from said top wall, said stand having a second section extending transversely from said first section, said second section extending laterally outward vertically aligned with said perimeter wall wherein said stand is configured for supporting a tattoo gun positioned adjacent to said housing;

a vibration control operationally coupled to said vibrational unit wherein manipulation of said vibration control selectively varies a frequency of vibration produced by said vibrational unit;

a power source electrically coupled to said vibrational unit; and a switch electrically coupled between said power source and said vibrational unit wherein manipulation of said switch selectively provides electric power to said vibrational unit from said power source.

2. The device of claim 1, further comprising said post comprising a top section and a bottom section, said top section being selectively removable from said bottom section.

3. The device of claim 1, further comprising said first motor and said second motor each being positioned proximate a respective end of said housing.

4. The device of claim 1, further comprising said top wall of said housing being planar.

5. The device of claim 1, further comprising said support wall being angled relative to said top wall wherein said support wall extends upwardly and away from said base wall.

6. The device of claim 5, further comprising a plurality of straps coupled to said support wall, each said strap being extendable between opposite side edges of said support wall and couplable to said support wall wherein each said strap is configured for securing the bottle on the support wall.

7. A bottle agitation device comprising:

a housing having a top wall, a bottom wall, and a perimeter wall coupled to and extending between said top wall and said bottom wall defining an interior space of said housing, said top wall of said housing being planar;

a post coupled to and extending upwardly from said top wall of said housing, said post comprising a top section and a bottom section, said top section being selectively removable from said bottom section;

a support wall coupled to an upper end of said post and a base wall coupled to an end of said support wall, said support wall being concavely arcuate wherein said support wall is configured for receiving and supporting a bottle thereon, said support wall being angled relative to said top wall wherein said support wall extends upwardly and away from said base wall;

a vibrational unit positioned in said housing, said vibrational unit agitating said support wall wherein said vibrational unit is configured for agitating the bottle when the bottle is supported on the support wall, said vibrational unit comprising a processor positioned in said housing and a first motor positioned in said housing, said first motor being operationally coupled to said processor wherein said processor controls operation of said first motor to vibrate said housing, said vibrational unit comprising a second motor positioned in said housing, said second motor being operationally coupled to said processor wherein said processor controls operation of said second motor to vibrate said housing, said first motor and said second motor each being positioned proximate a respective end of said housing;

a plurality of straps coupled to said support wall, each said strap being extendable between opposite side edges of said support wall and couplable to said support wall wherein each said strap is configured for securing the bottle on the support wall;

a stand coupled to and extending upwardly from said housing, said stand extending from said top wall, said stand having a first straight section extending transversely from said top wall, said stand having a second section extending transversely from said first section, said second section extending laterally outward vertically aligned with said perimeter wall wherein said stand is configured for supporting a tattoo gun positioned adjacent to said housing;

a vibration control operationally coupled to said vibrational unit wherein manipulation of said vibration control selectively varies a frequency of vibration produced by said vibrational unit;

a power source electrically coupled to said vibrational unit; and a switch electrically coupled between said power source and said vibrational unit wherein manipulation of said switch selectively provides electric power to said vibrational unit from said power source.

* * * * *